US011298851B2

(12) United States Patent
Eckert et al.

(10) Patent No.: US 11,298,851 B2
(45) Date of Patent: Apr. 12, 2022

(54) TOOL HEAD AND METHOD FOR INSERTING AND CLAMPING A CUTTING INSERT, AND CUTTING INSERT

(71) Applicant: OERTLI WERKZEUGE AG, Hori bei Bulach (CH)

(72) Inventors: Manfred Eckert, Lauchringen (DE); Bruno Ehrle, Neuhausen am Rheinfall (CH); Zoran Ostojic, Regensdorf (CH); Michel Paglione, Neunkirch (CH); Erich Meili Kai, Winterthur (CH)

( * ) Notice: Subject to any disclaimer, the term of this patent is extended or adjusted under 35 U.S.C. 154(b) by 66 days.

(21) Appl. No.: 16/733,108

(22) Filed: Jan. 2, 2020

(65) Prior Publication Data

US 2020/0130224 A1 Apr. 30, 2020

Related U.S. Application Data

(63) Continuation of application No. 15/304,221, filed as application No. PCT/CH2015/000055 on Apr. 14, 2015, now abandoned.

(30) Foreign Application Priority Data

Apr. 14, 2014 (CH) ..... 569/2014

(51) Int. Cl.
*B27G 13/04* (2006.01)
*B27G 13/10* (2006.01)
*B27G 13/12* (2006.01)

(52) U.S. Cl.
CPC ..... *B27G 13/04* (2013.01); *B27G 13/10* (2013.01); *B27G 13/12* (2013.01)

(58) Field of Classification Search
CPC ..... B27G 13/00; B27G 13/005; B27G 13/02; B27G 13/04; B27G 13/06; B27G 13/08; B27G 13/10
(Continued)

(56) References Cited

U.S. PATENT DOCUMENTS 1,315,536 A 9/1919 Usher
1,611,298 A 5/1924 Wilderson
(Continued)

FOREIGN PATENT DOCUMENTS

CH 227645 6/1943
CH 619880 10/1980
(Continued)

OTHER PUBLICATIONS

Tool Head and Method for Inserting and Clamping a Cutting Insert, and Cutting Insert, U.S. Appl. No. 15/304,221, filed Oct. 14, 2016.

*Primary Examiner* — Jessica Cahill
*Assistant Examiner* — Smith Oberto Bapthelus
(74) *Attorney, Agent, or Firm* — Morriss O'Bryant Compagni Cannon, PLLC

(57) ABSTRACT

The invention relates to a tool head for a woodworking machine, having a cylindrical, conical or profiled main part, which has at least two tool-receiving portions evenly distributed across its circumference for holding the cutting insert. The tool-receiving portions each have grooves tapering in the radial direction, in which one cutting insert per groove is clamped between a first side wall of the groove and a closing element. A first interlocking connection is provided between the cutting insert and the first side wall. In addition, a centrifugal wedge is arranged between the closing element and a second side wall situated opposite the first side wall of the groove. According to the invention, a second interlocking connection is provided between the closing element and the centrifugal wedge. This permits radial insertion of a cutting insert.

22 Claims, 14 Drawing Sheets

Figure 1:
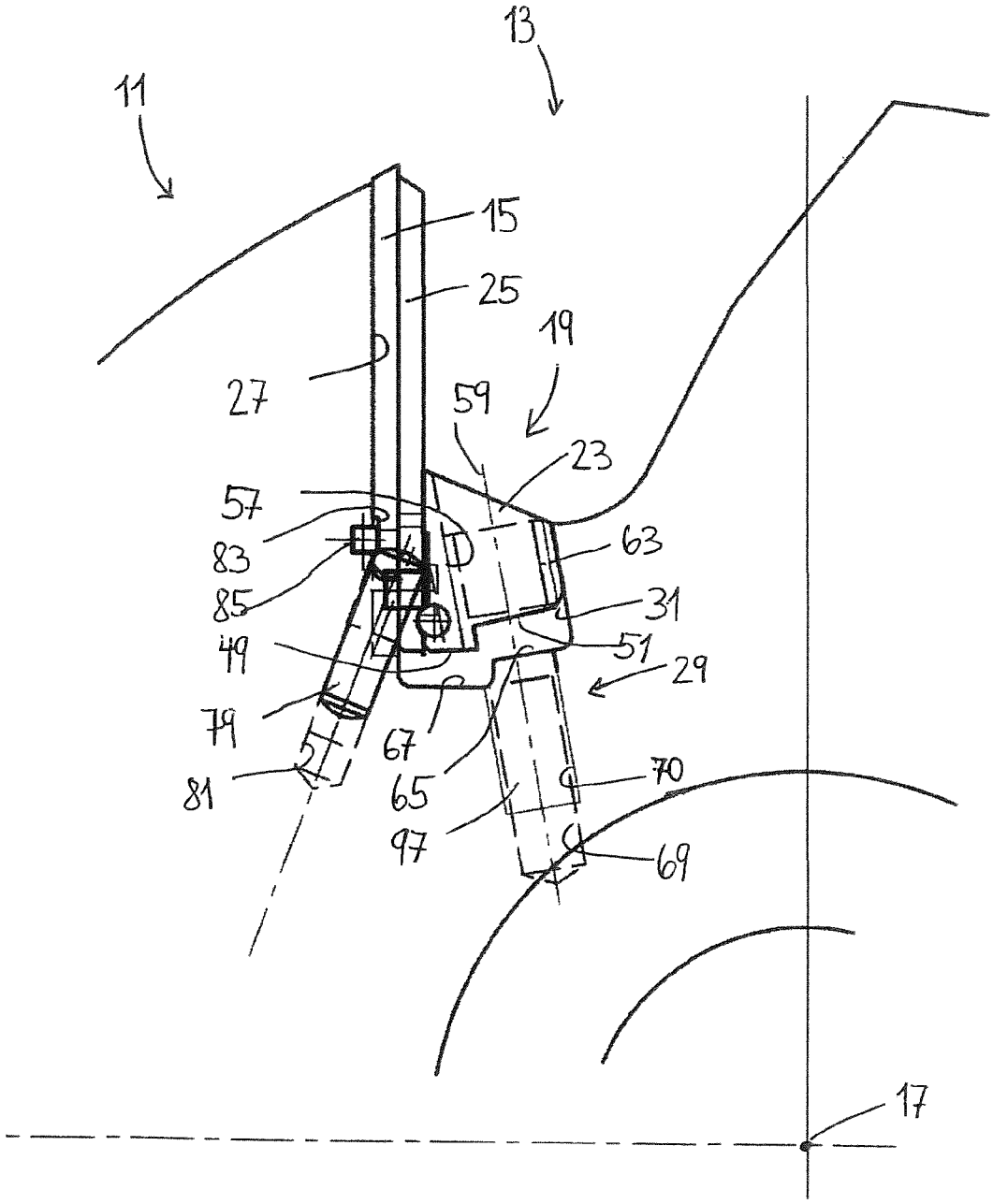

(58) Field of Classification Search
USPC ..... 144/218–235
See application file for complete search history.

(56) References Cited

U.S. PATENT DOCUMENTS

| | | | | |
|---|---|---|---|---|
| 2,652,749 | A | 9/1953 | Hagmeister | |
| 2,702,059 | A | 2/1955 | Ballantine | |
| 3,039,503 | A | 6/1962 | Mainone | |
| 3,742,565 | A | 7/1973 | Boboltz | |
| 4,068,694 | A | 1/1978 | Schmidt | |
| 4,257,302 | A | 3/1981 | Heimbrand | |
| 4,470,442 | A | 9/1984 | Krautzberger | |
| 4,475,425 | A | 10/1984 | Punater | |
| 4,658,875 | A | 4/1987 | Grabovac | |
| 4,907,631 | A | 3/1990 | Krautzberger | |
| 5,133,394 | A | 7/1992 | Landtwing | |
| 5,163,490 | A | 11/1992 | Meis | |
| 5,209,278 | A | 5/1993 | Carpenter | |
| 5,240,192 | A * | 8/1993 | Tilby | B02C 18/186 241/292.1 |
| 5,333,659 | A | 8/1994 | Carpenter | |
| 5,352,067 | A | 10/1994 | Arai | |
| 5,456,300 | A | 10/1995 | Rosenkranz | |
| 5,558,142 | A | 9/1996 | Ehrle | |
| 5,800,079 | A | 9/1998 | Qvarth | |
| 5,857,506 | A | 1/1999 | Paolone | |
| 6,058,989 | A | 5/2000 | LaGrange | |
| 6,095,211 | A | 8/2000 | Chiang | |
| 6,119,741 | A | 9/2000 | Rowe | |
| 6,279,444 | B1 | 8/2001 | Kellner | |
| 6,378,578 | B2 | 4/2002 | Thomas | |
| 6,662,837 | B2 | 12/2003 | Smith | |
| 6,811,362 | B2 | 11/2004 | Wallin | |
| 6,926,051 | B2 | 8/2005 | Engman | |
| RE38,930 | E | 1/2006 | Swartwood | |
| 7,140,408 | B1 | 11/2006 | Hinchliff | |
| 7,300,231 | B1 | 11/2007 | Liu | |
| 7,517,178 | B2 | 4/2009 | Martin | |
| 7,703,487 | B2 | 4/2010 | Garcia | |
| 7,703,713 | B2 | 4/2010 | Smith | |
| 7,735,531 | B2 | 6/2010 | Gilbert | |
| 8,192,112 | B2 | 6/2012 | Turcot | |
| 8,262,323 | B2 | 9/2012 | Satran | |
| 8,739,844 | B2 | 6/2014 | Patsch | |
| 2002/0046632 | A1 | 4/2002 | Wallin et al. | |
| 2003/0196724 | A1 | 10/2003 | Wixey | |
| 2005/0265795 | A1 | 12/2005 | Misenheimer et al. | |
| 2010/0319810 | A1 | 12/2010 | Patsch | |
| 2013/0214076 | A1 | 8/2013 | Zinniger | |
| 2017/0028583 | A1 | 2/2017 | Eckert | |

FOREIGN PATENT DOCUMENTS

| | | |
|---|---|---|
| CH | 679755 | 4/1992 |
| DE | 231554 | 2/1911 |
| DE | 712851 | 10/1941 |
| DE | 1693811 | 2/1955 |
| DE | 32852 | 11/1964 |
| DE | 3636618 | 5/1988 |
| DE | 8914809 | 2/1990 |
| DE | 9108553 | 9/1991 |
| DE | 4334852 | 4/1995 |
| DE | 29506458 | 7/1995 |
| EP | 0054536 | 6/1982 |
| EP | 0152125 | 8/1985 |
| EP | 0428996 | 11/1990 |
| EP | 0951974 | 10/1999 |
| EP | 1574307 | 9/2005 |
| EP | 1857240 | 11/2007 |
| WO | 9403311 | 2/1994 |
| WO | 2015157871 A2 | 10/2015 |

* cited by examiner

TOOL HEAD AND METHOD FOR INSERTING AND CLAMPING A CUTTING INSERT, AND CUTTING INSERT

CROSS-REFERENCE TO RELATED APPLICATIONS

This application claims priority to U.S. patent application Ser. No. 15/304,221 filed on Oct. 14, 2016, which is a national phase entry under 35 U.S.C. § 371 of PCT/CH2015/000055 filed on Apr. 14, 2015, which claims priority to Swiss Patent Application 569/2014 filed on Apr. 14, 2014, the entirety of each of which is incorporated by this reference.

The invention relates to a tool head, to a cutting insert and to a method for inserting and clamping a cutting insert.

PRIOR ART

DE-OS 36 36 618 discloses a cutter block for cutting woodworking machines, in particular for planning machines. It has a one-piece cutter block body which has a plurality of axially parallel grooves which taper towards the lateral surface and in which sits a respective profiled disposable blade which is clamped by a centrifugal wedge and engages positively into a corresponding profiling of the side face of a retaining ledge located between the disposable blade and the centrifugal wedge. In this respect, the retaining ledge is joined in an unmovable manner to the cutter block body and is elastically deformable. It is arranged at such a distance from the side wall of the groove that, when the centrifugal wedge is released, an interpositioned blade can be easily removed in the longitudinal direction and a new blade can be inserted without practically any clearance. When the centrifugal wedge generates the clamping force by rotating, the retaining ledge is pressed firmly against the disposable blade due to a slight elastic deformation so that said blade is fixedly located in an unmovable manner. However, the blade can only be clamped in a single unchangeable position.

German utility model DE-U-89 14 809 discloses a cutter head for machining wood, plastics and the like, particularly for the longitudinal profiling of strips and boards, having a cylindrical main part which has a plurality of axially parallel grooves which are open towards the lateral surface. A blade is clamped in each groove between a side wall of the groove and a retaining ledge, a tooth system of the back of the blade meshing positively with a corresponding tooth system of the side wall. The groove towards the lateral surface of the main part is tapered in a wedge shape. Arranged in this groove is a centrifugal wedge which firmly clamps the blade between the retaining ledge and the other side wall when the main part rotates.

US patent application No. 2002/0046632 discloses a tool body having one or more tool mounts, into which blades can be inserted which are held by a clamping mechanism. To minimise the tool costs, US 2002/0046632 proposes re-sharpening the blades and removing an equal amount from the bottom of the blade, thus generating a new reference edge. At a distance from the base of the blade, the inserted blades have a groove into which a protruding rib engages, which is configured in the tool mount, when the blade is clamped in the mount. The groove is provided in the flat side of the blade opposite the cutting edge and prevents the blade from being able to slip radially during operation. According to US 2002/0046632, to achieve the same objective, the rib can alternatively be provided on the fixing wedge.

US patent application No. 2005/0265795 discloses a tool head having a tool mount in which a blade can be clamped by a fixing wedge. The blade has a bevel with the cutting edge on the bottom of the blade and opposite the flat side, which bevel creates the necessary free space when the blade is inserted into the opening in the tool mount.

To replace or adjust the blade, the centrifugal wedge is firstly released by a radially inwardly directed force effect, for example by a hammer blow. The retaining ledge which, in the clamped state, is slightly elastically deformed towards the blade, returns into its relaxed position. In this position which is fixed precisely by the stop angle between the two ledges, the seat of the blade is loosened to such an extent that the blade can be easily removed in the direction of the axis of the main part. Thereafter, optionally after grinding, the blade can be reinserted in the axial direction, for example in a position which is displaced outwards by a tooth width. As soon as the cutter head is set into fast rotation, the centrifugal wedge is tightened by centrifugal force. The blade is then clamped in a fixed and precise manner. Since the centrifugal wedge is configured to be self-locking, it remains clamped even after the cutter head has stopped. An advantage of the described cutter head is that the screws do not have to be undone when the blade is changed. However, a disadvantage is that the blade can only be removed in an axial direction from the groove. This means that first of all, adjacent cutter heads have to be removed from the tool spindle before the blade can be removed.

In the case of cutter heads with conventional blade holders without centrifugal wedges, when wide blades are used, a plurality of screws is generally required to fix the blades to the cutter head. This necessitates more effort during a change of blade. A further problem with conventional cutter heads of this type is that the pressure bodies are fastened by screws in a groove in the cutter head against the centrifugal force which arises during rotation. With high rotational speeds, the blade can move slightly due to the effective centrifugal forces, which adversely affects the woodworking accuracy and results in relatively high tolerances.

Advantages of the Invention

It is therefore an advantage of the present invention to provide a tool head, in particular a cutter head for a woodworking machine tool, and a method in which the tool, respectively the blade can be inserted and removed in a radial direction. A further advantage is to provide a tool head for which, during a change of tool or blade, it is no longer necessary to previously dismantle tool heads which are adjacent to the tool head. A further advantage is to propose a tool head, for which the effort in changing tools is minimised. A further advantage is that during a tool change, the new tool is precisely adjusted in a radial direction and in an axial direction.

DESCRIPTION

The aforementioned advantages are realised according to the invention by the features of the claims. Advantageous developments are defined in the subclaims.

The invention relates to a tool head, in particular to a cutter head for a woodworking machine, having a cylindrical, conical or profiled main part for the rotating machining of a workpiece. The tool head has at least two tool mounts, evenly distributed over its circumference, for receiving a flat tool, in particular a cutting insert. The tool mounts respectively have grooves which taper in the radial direction and in which a respective cutting insert can be clamped between a first side wall of the groove and a closure element which serves as a pressure jaw. A centrifugal wedge which can be inserted into the groove can press the closure element against the cutting insert and can fix said cutting insert in the tool mount. Provided between the cutting insert and the first side wall is a first positive locking connection which fixes the cutting insert in the radial direction.

According to the invention, a second positive locking connection is provided between the closure element and the centrifugal wedge. This arrangement of the positive locking connections, namely between the cutting insert and the tool head on the one hand and between the closure element and the centrifugal wedge on the other has the advantage that, during clamping, a relative movement between closure element and cutting insert is possible, because there is no positive locking connection between the cutting insert and the closure element. The proposed arrangement of the positive locking connections also means that the cutting insert can be inserted into the groove in the radial direction.

The centrifugal wedge advantageously has a hole with an internal thread, into which a clamping screw with an external thread can be inserted. In this respect, by turning the clamping screw in a first direction, the centrifugal wedge can be moved into the clamping position and by turning the clamping screw in a second, opposite direction, the centrifugal wedge can be moved into the tool change position. Compared to the prior art, this tool holder has the advantage that the centrifugal wedge is pretensioned radially outwards even when the tool is clamped. This has the advantage that the centrifugal wedge and the cutting insert no longer move as the tool head starts to rotate. According to an advantageous embodiment, the clamping screw is a threaded pin, on the one end face of which is formed an engagement means, for example a hexagon socket or a Torx screw profile, and on the second end face of which is formed a cylindrical screw head. When the centrifugal wedge is inserted into the tool mount, the cylindrical screw head rests against the base of the groove which acts as a counter bearing. It is conceivable for the screw head to have on its end face a locking extension which can engage with clearance in a corresponding blind hole in the base of the groove. This has the advantage that the centrifugal wedge cannot move in the groove. Moreover, the blind hole and locking extension are configured so that it is possible to radially pre-assemble the clamping screw.

A screw hole with an internal thread is advantageously provided in the base of the groove, and the shank of the clamping screw has two threaded portions with opposed screw threads. This has the advantage that with an appropriate choice of the rotational direction of the screw thread, the centrifugal wedge moves away from the base of the groove when the clamping screw is screwed into the screw hole. According to another embodiment, the clamping screw can be inserted rotatably but immovably in the axial direction into the hole in the centrifugal wedge. In this way as well, the centrifugal wedge can be pressed against the closure element by turning the clamping screw.

The closure element is expediently received, respectively fixed in the tool mount without screws. This has the advantage that it can be quickly inserted or removed. This facilitates the tool change.

According to one embodiment, either the closure element or the centrifugal wedge is fitted with at least one magnet. The provision of at least one magnet has the advantage that the cutting insert which is advantageously produced from a weakly magnetisable material is held on the closure element. This has the advantage that the cutting insert is drawn onto the closure element in the tool change position. Since the cutting insert is also tilted when the centrifugal wedge is released, the cutting insert can be effectively grasped using fingers.

The at least one magnet is inserted into an opening in the closure element so that it is flush with the surface of the closure element. This has the advantage that the cutting insert can rest flatly on the closure element. For reasons of symmetry, at least two spaced-apart openings are expediently provided in the closure element, magnets being inserted flush into said openings.

The one or more openings are advantageously provided in the lower region of the closure element at a short distance from the base of the closure element, particularly in the lower third of the closure element. However, other positions are equally possible, subject to the dimensions of the cutting insert.

According to a particularly advantageous embodiment, a pressure element or spring element is provided which is positioned between, respectively in the groove, so that it acts on the cutting insert in the radial direction when the tool is clamped. The pressure element is advantageously elastically or resiliently deformable and is produced, for example from an elastically deformable plastics or a spring element, for example a coil spring. The pressure element or spring element is located where the lower edge of the cutting insert rests on a shoulder of the tool mount, so that the pressure element or spring element can cooperate with the lower edge of the cutting insert. The pressure element or spring element can be inserted into the groove or arranged on the closure element.

An expedient embodiment provides that the pressure element or spring element is provided or arranged on the closure element. In this respect, it can be arranged under the magnets, i.e. closer to the base of the closure element, seen in the longitudinal direction. The pressure element or spring element can be configured as a plastics positioning nub which projects from the surface. The positioning nub can be inserted, for example into a hole in the closure element.

According to another embodiment, the pressure element or spring element is a spring which is simultaneously used for the lateral and radial positioning of the blade and for pressing the closure element onto the jaws of the centrifugal wedge.

The centrifugal wedge advantageously has a front wedge surface which is oriented towards the first side wall of the groove, and a rear surface which is opposite the wedge surface, is oriented towards the second side wall of the groove and is at an acute angle to the front wedge surface. The wedge surface has a channel-shaped recess which runs in the axial direction. The recess has the advantage that the contact pressure is concentrated on the regions of the centrifugal wedge which are adjacent to the recess.

An elevation which extends in the axial direction is advantageously provided on the wedge surface. The elevation, for example an elongate bead can provide a positive locking with the closure element.

Expediently provided above the recess is a first pressure surface and provided below the recess is a second pressure surface of a minimum width of at least 1 mm, at least 2 mm, or at least 3 mm.

The first side wall of the groove includes an angle of between 0 and 40 degrees, between 15 and 35 degrees or between 20 and 30 degrees with a radial emanating from the centre of the tool head.

The base of the centrifugal wedge is advantageously configured with a step which extends parallel to the longitudinal axis of the hole, thereby providing a first base surface which adjoins the front wedge surface and a second base surface which adjoins the rear surface. In this respect, the second base surface includes an angle of >90 degrees, preferably between 90.1 and 95 degrees or between 90.5 and 94 degrees with the rear surface. This physical formation of the centrifugal wedge has the advantage that a tilting movement of the centrifugal wedge can be caused on releasing the tool holder.

A centring pin can be introduced in the first groove wall (for example press fit), for laterally centring the cutting insert and optionally the closure element.

According to a particularly advantageous embodiment, provided between the centrifugal wedge and the closure element is a third positive locking connection for laterally centring the closure element. This is a particularly advantageous embodiment which, together with the second positive locking connection, allows the radial and axial adjustment of the cutting insert.

The present invention also provides a cutting insert for a tool head of a woodworking machine having a cutting insert, a cutting edge, formed on a first side (front of the blade) of the cutting insert, and a positioning channel which is provided on the second side of the cutting insert opposite the cutting edge. This cutting insert according to the invention is distinguished in that the edge of the cutting insert diagonally opposite the cutting edge has a functional surface in the form of a bevel or a rounding, the depth of which is at least 15% of the thickness of the cutting insert. This cutting insert has the advantage that it can be positively fixed directly in the tool body. The bevel is advantageously 0.6 mm. The advantage of this bevel which is significantly larger compared to known cutting inserts is that an elastically deformable pressure element can expand through the increased free space between the groove wall and cutting insert when the centrifugal wedge is clamped. Thus, the larger bevel is significant in connection with the correct radial positioning of the cutting insert. In addition, this functional surface also has a safety relevance, since without it, the brittle cutting inserts could break while they are being clamped and could fly off during operation.

Only a single positioning channel is provided, the lower edge of which is located at a distance of <10 mm or <8 mm from the base surface of the cutting inserts.

It is also significant that the positioning channel is located inside a clamping region. This clamping region is on the one hand restricted in depth by the shoulder of the first groove wall and on the other hand is restricted in height by the apex of the top surface of the centrifugal wedge, and of the first pressure surface of the centrifugal wedge.

The cutting insert advantageously has at least one U-shaped recess for lateral positioning. However, it is also possible for the cutting insert not to have a U-shaped recess. In this case, the lateral positioning can be performed, for example by two lateral positioning elements, between which the cutting insert is arranged.

The present invention also provides a method for inserting and clamping a tool in a mount of a tool head in which method the closure element is held positively by the centrifugal wedge after being inserted into the tool mount.

According to another independent aspect of the invention, the closure element is held in the change position by the centrifugal wedge, and the tool is held in the clamping position by a positive locking connection with a side wall.

According to a further independent aspect of the invention, the centrifugal wedge is moved into the clamping position and into the change position by means of a clamping screw. The advantages associated with the previously mentioned variants of the method have already been discussed above in the discussion of the tool head according to the invention.

The cutting insert is advantageously clamped in the centrifugal force direction by a clamping screw which engages on the centrifugal wedge. This has the advantage that the centrifugal wedge no longer moves due to the centrifugal forces which are effective during operation of the rotating tool head. A consequence of this is a greater precision during the machining of the workpieces.

Before the cutting insert reaches its final clamping position, it is pressed outwards in the radial direction against a stop. This has the advantage that the cutting insert is accurately positioned in the tool mount and cannot slip during operation.

Before reaching the final position, the tool is advantageously positioned, respectively strikes against a stop ledge by means of a resilient element.

In the change position, the cutting insert is advantageously drawn in a releasable manner onto the closure element. This is expediently performed by means of a magnet which can be arranged on the closure element or on the centrifugal wedge.

According to a particularly advantageous variant of the method, the centrifugal wedge is released by means of the clamping screw. Thus, in contrast to the prior art, the centrifugal wedge can be released without using a hammer.

The closure element is advantageously held positively by the centrifugal wedge in the tool change position.

The cutting insert is advantageously clamped on the stop and in the flight direction.

The present invention also relates to a tool head for a woodworking machine, having a cylindrical, conical or profiled main part which has at least two tool mounts which are distributed evenly over its circumference, for receiving a cutting insert, a single tool mount being formed by a groove which is open in the radial direction. The groove is formed by a first side wall and by a second side wall opposite the first side wall and at a distance therefrom. A centrifugal wedge can be arranged in the groove in order to clamp a cutting insert which is arranged between the first side wall and the centrifugal wedge, in that the centrifugal wedge is moved radially outwards by a clamping screw.

This tool head is further characterised in that provided in the tool mount is a spring element which radially presses a cutting insert, introduced into the tool mount, against a stop. The tool head configured thus has the great advantage that during clamping, the tool is radially positioned automatically in that it is automatically moved radially outwards by the spring means and is brought against a projection provided on the tool. This measure provides an exact positioning of the cutting inserts in the tool mount without any additional effort and expense.

The spring element can be a spring or an elastically deformable plastics part or metal part which engages in a recess in the cutting insert or engages against the base of the blade.

The invention also provides a method for positioning a cutting insert in a tool mount of a tool head, in which method a cutting insert, introduced into the tool mount, is pressed against a stop by means of a spring element which is provided in the tool mount and is oriented accordingly, in that the spring element exerts a radially outwardly effective force on the cutting insert. In this respect, it is significant that positioning takes place automatically when the tool is clamped. The spring element can ensure the radial, the lateral or the lateral and radial positioning.

Figure 2:
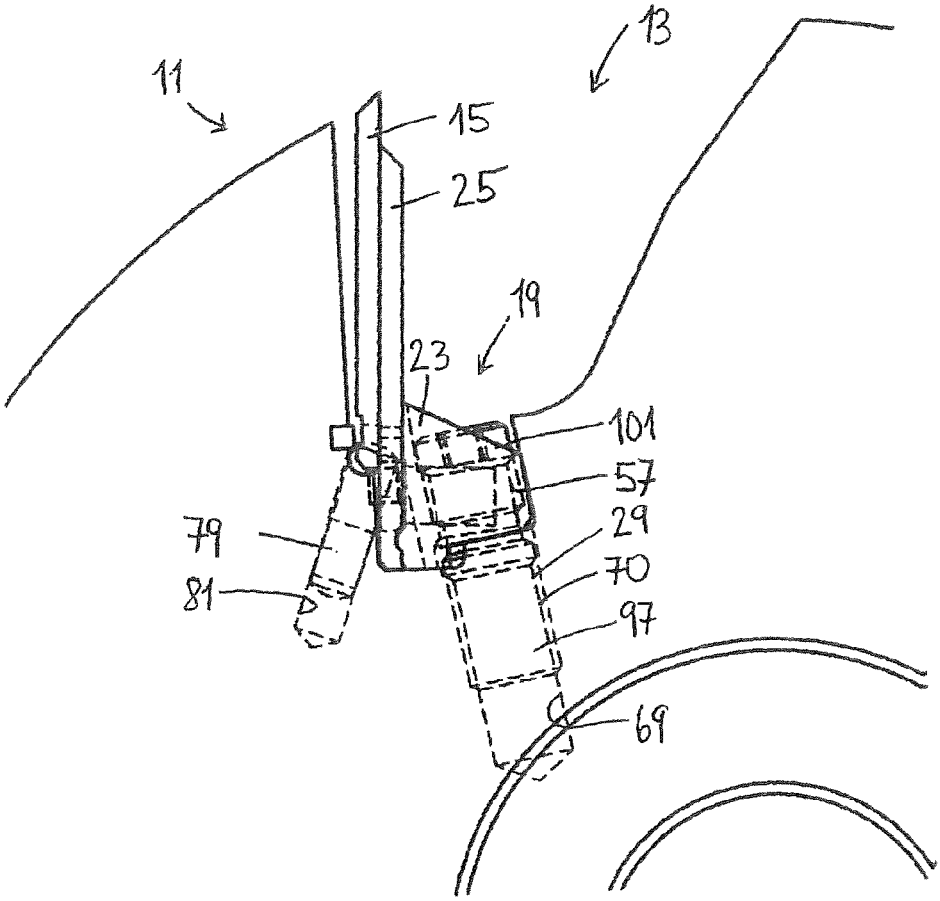
Figure 3:
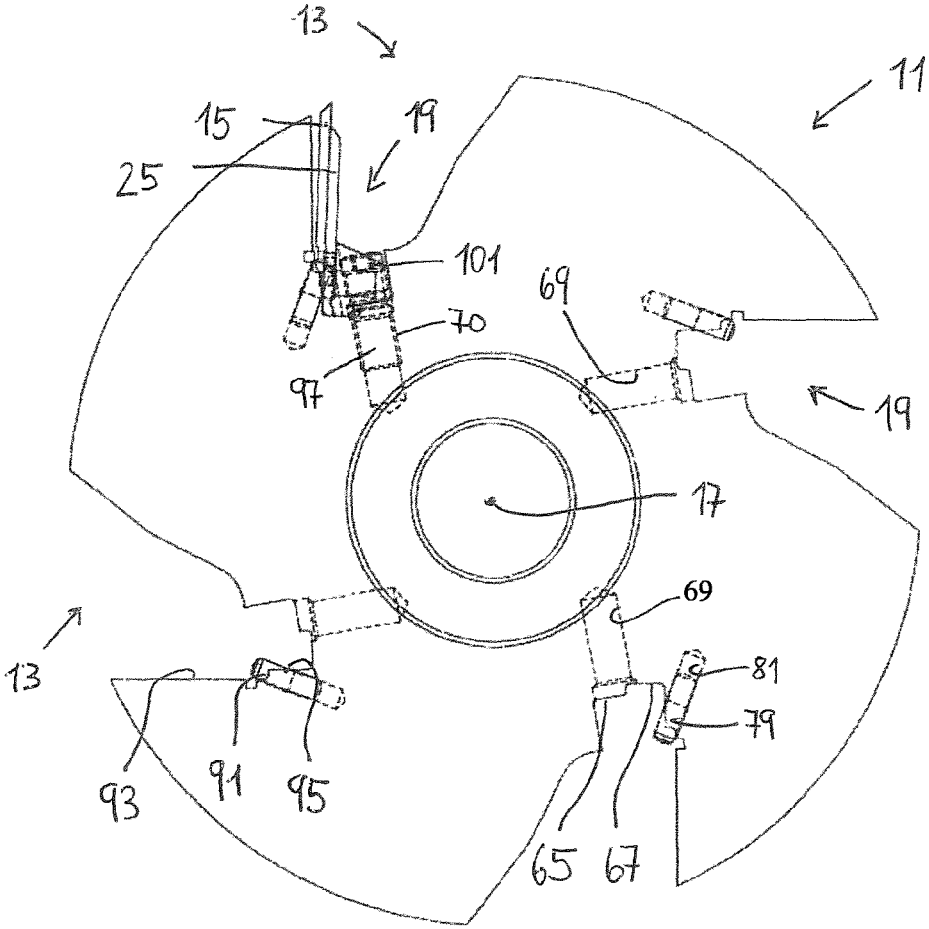
Figure 4:
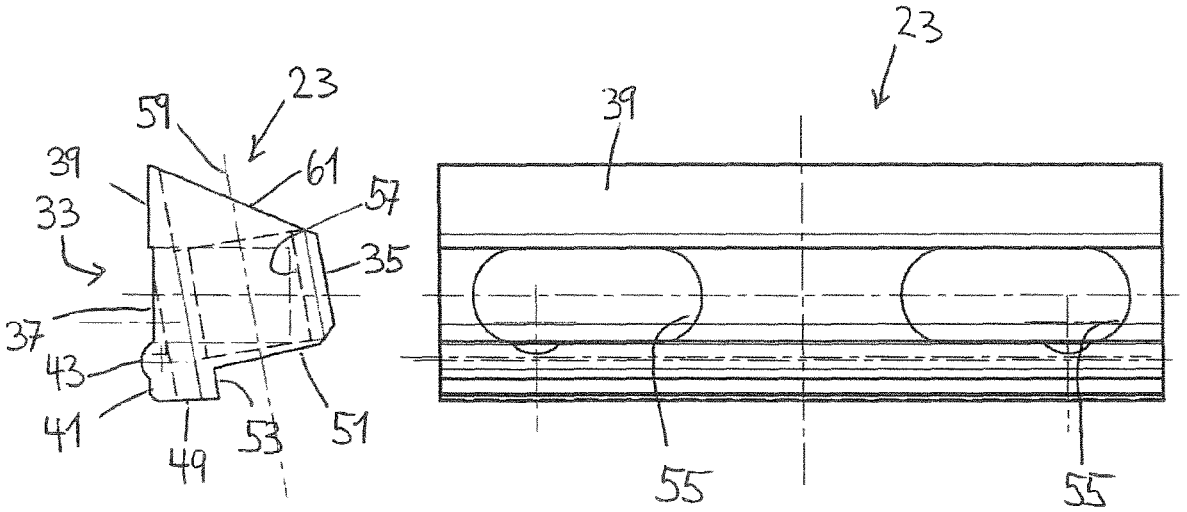
Figure 5:
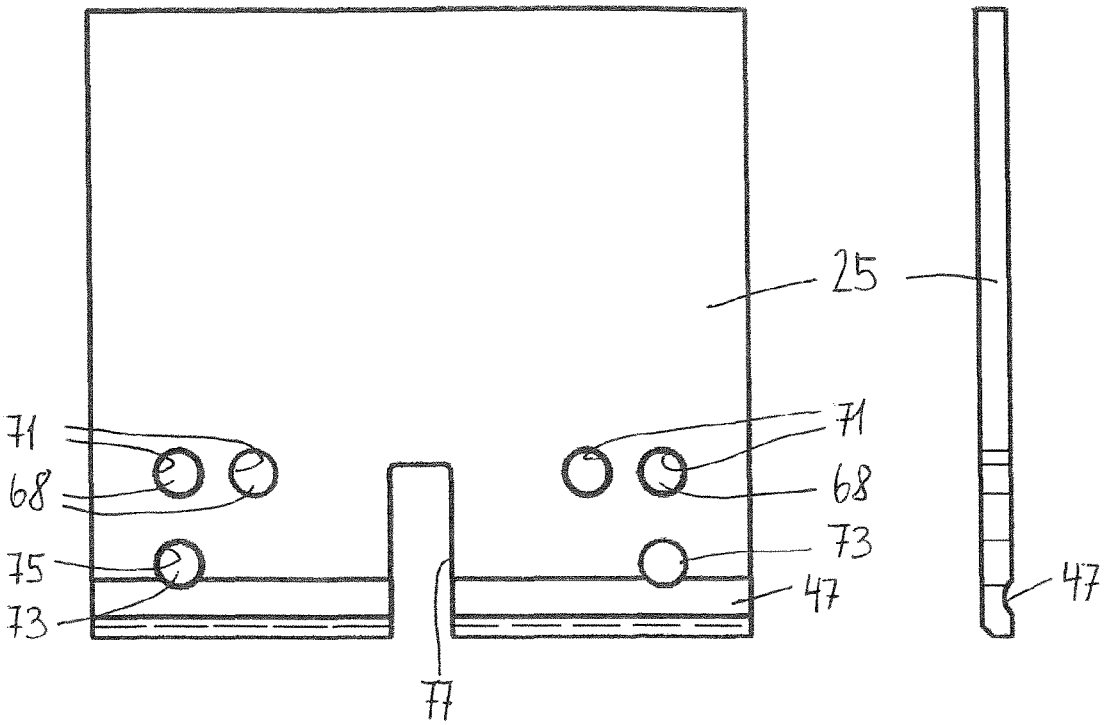
Figure 6:
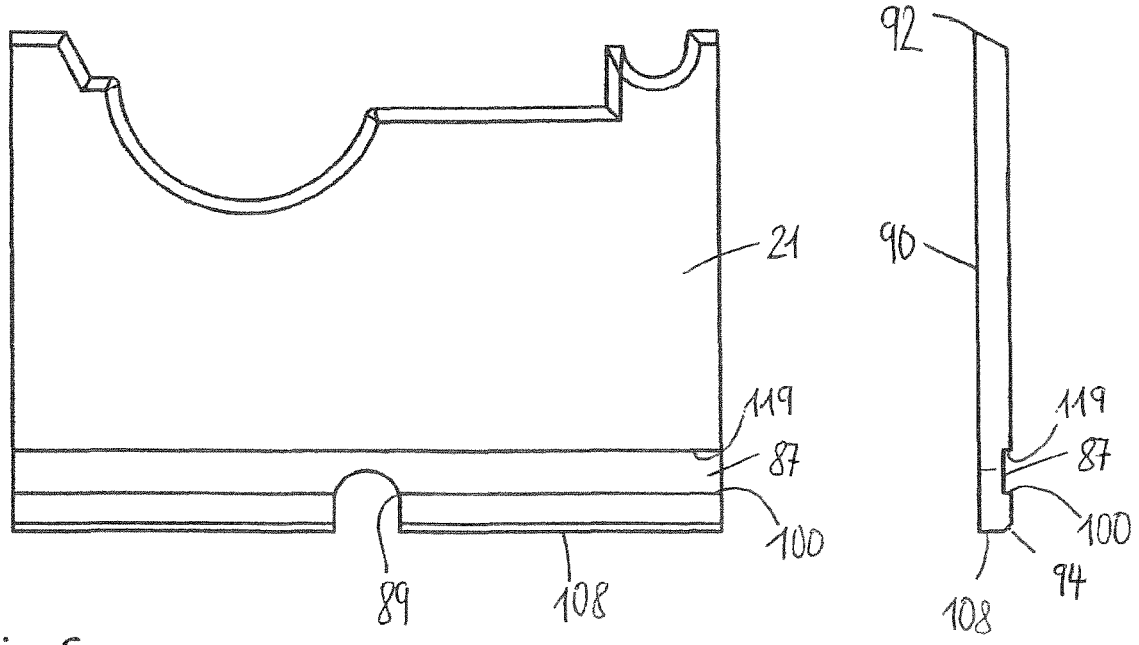
Figure 7:
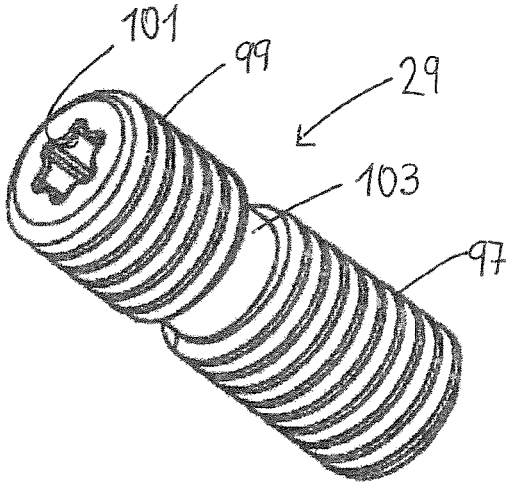
Figure 8:
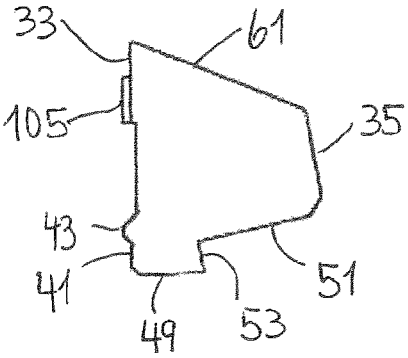
Figure 8:
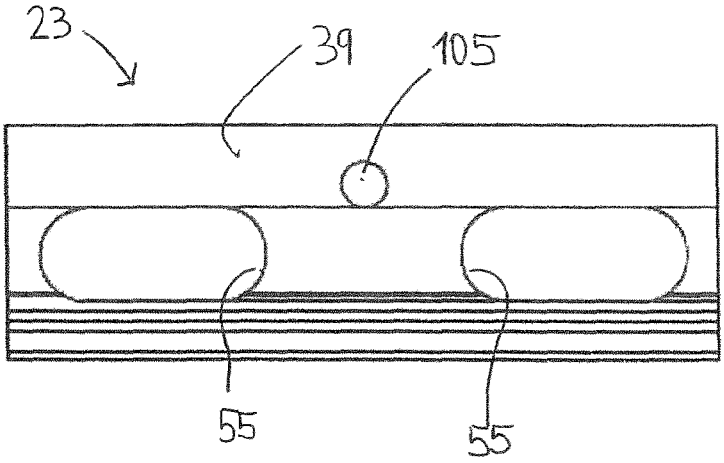
Figure 9:
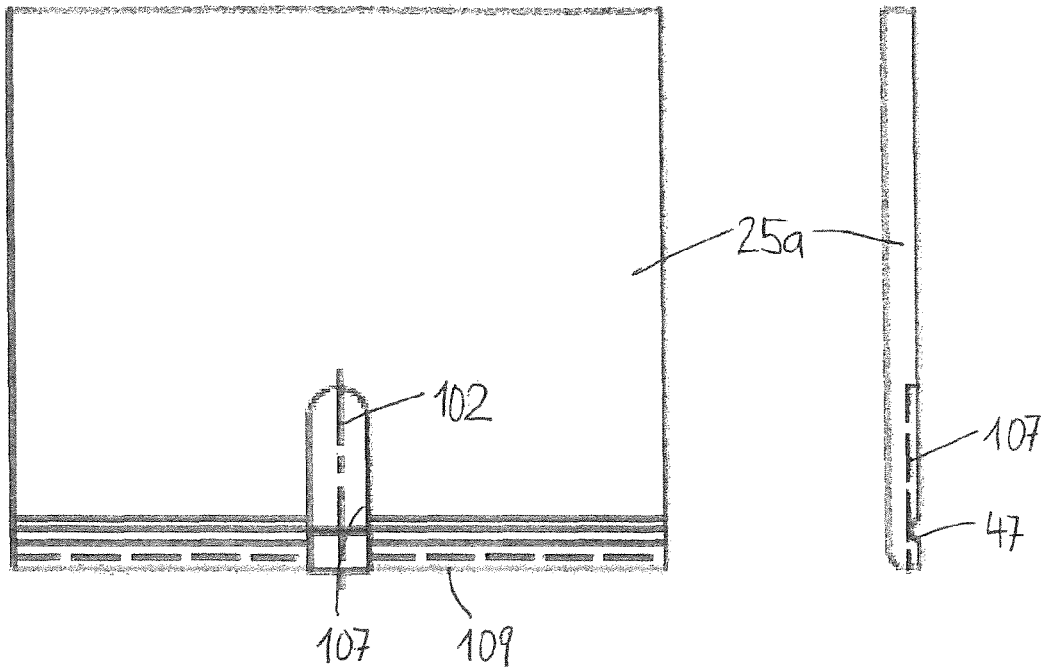
Figure 10:
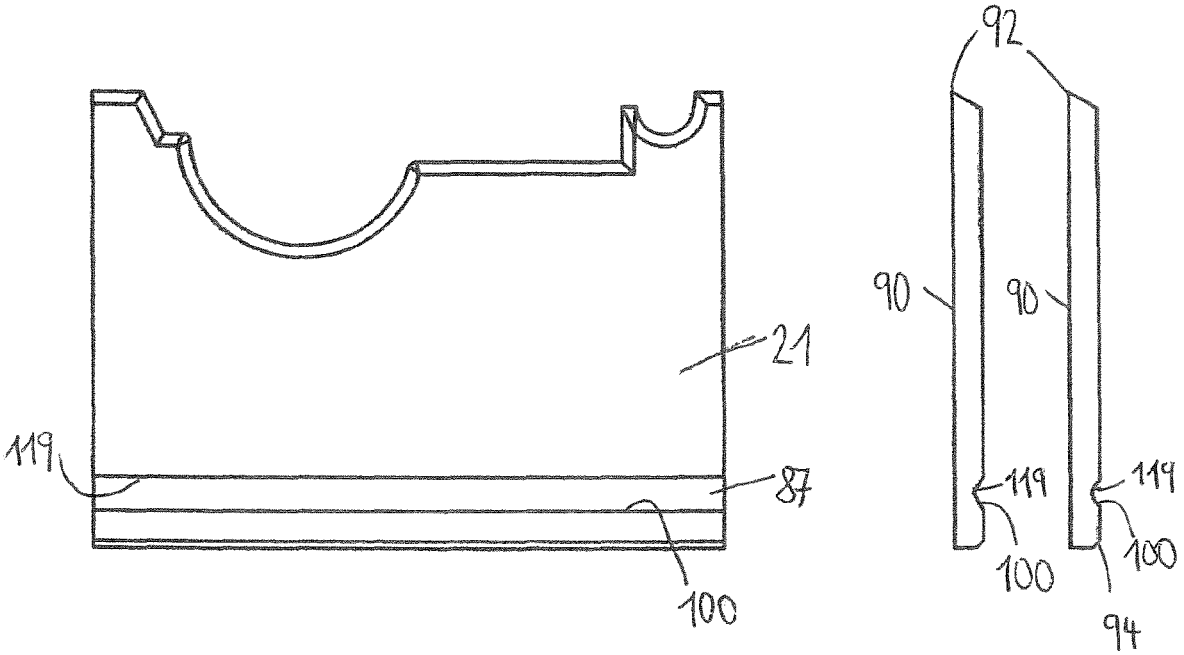
Figure 11:
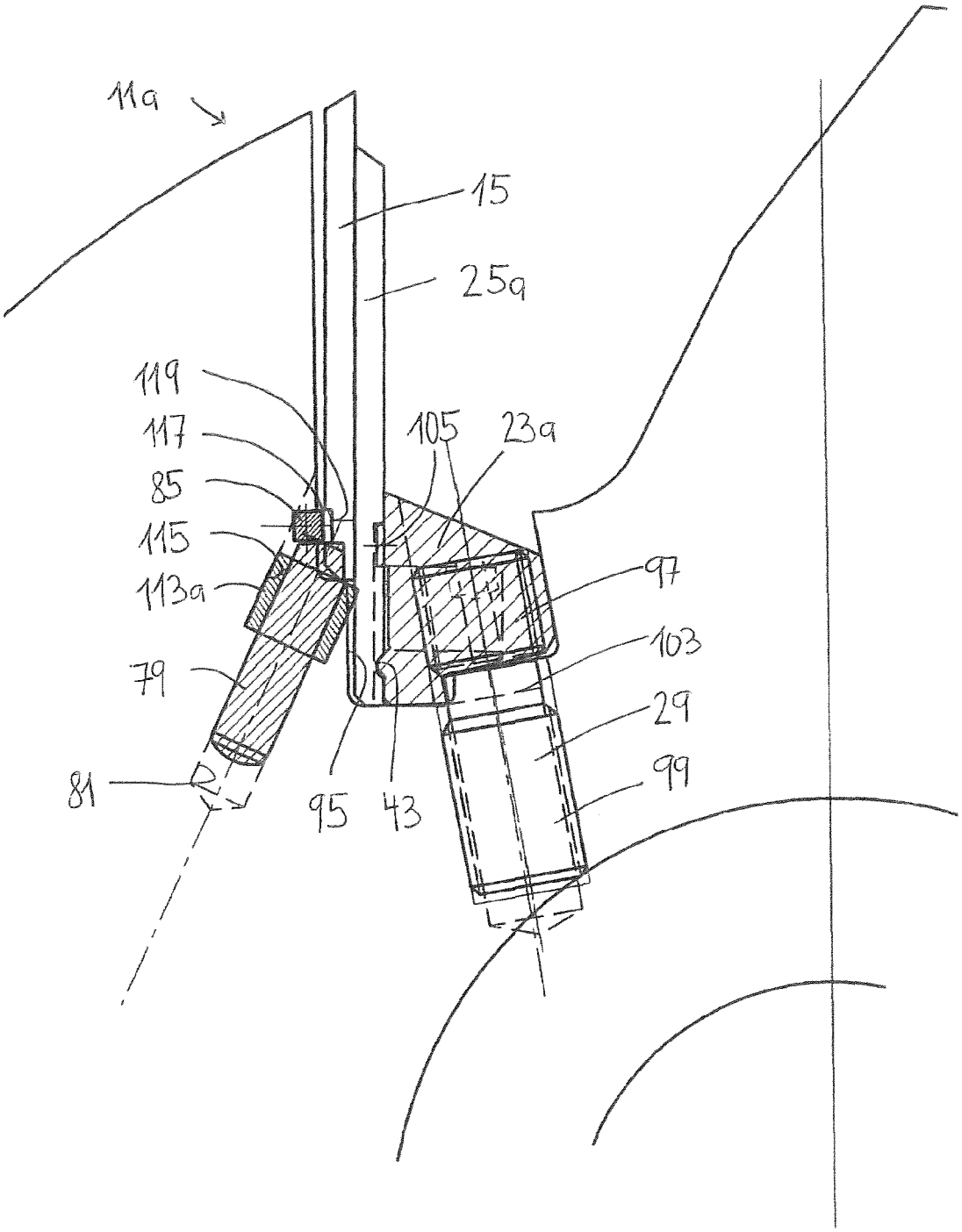
Figure 12:
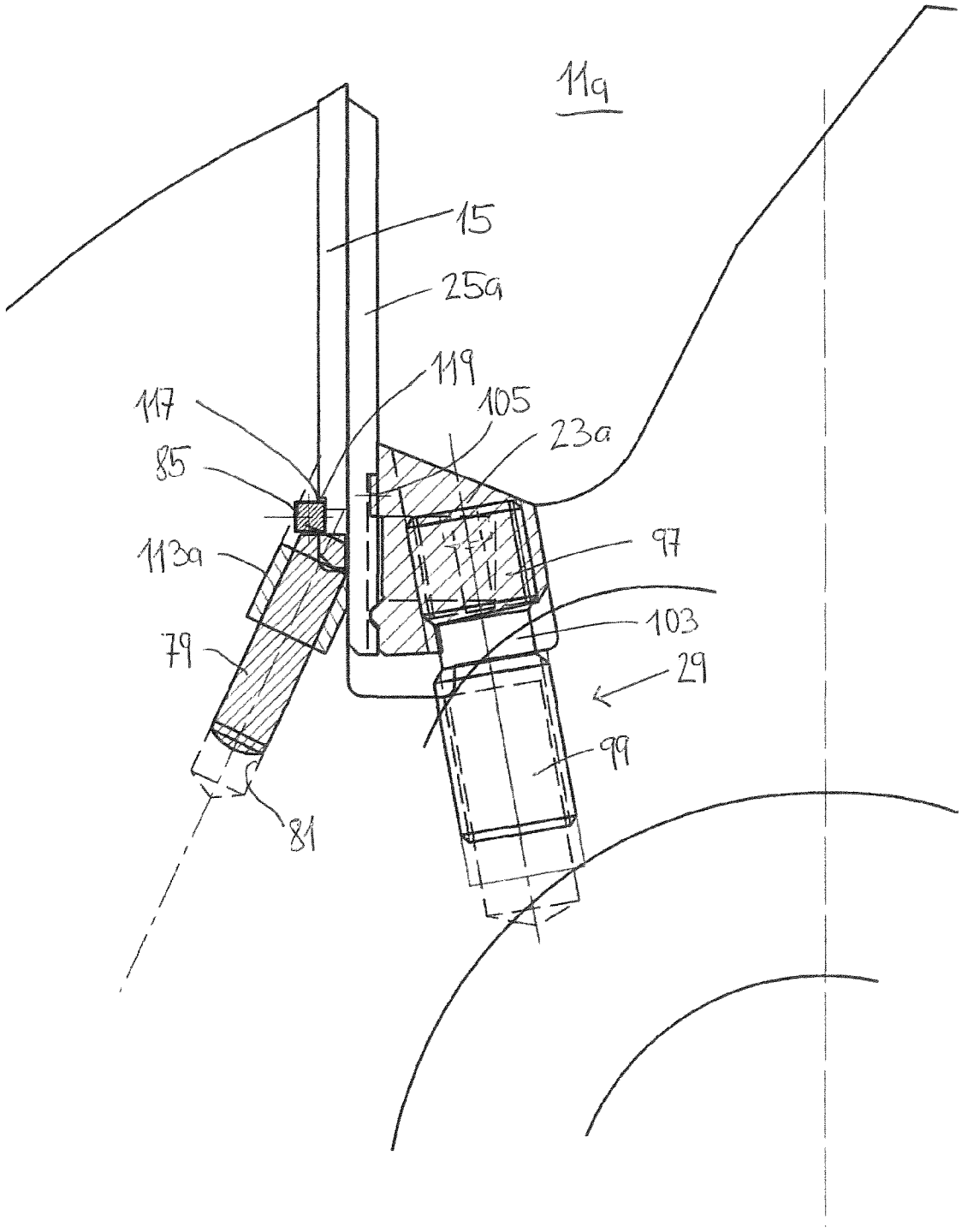
Figure 13:
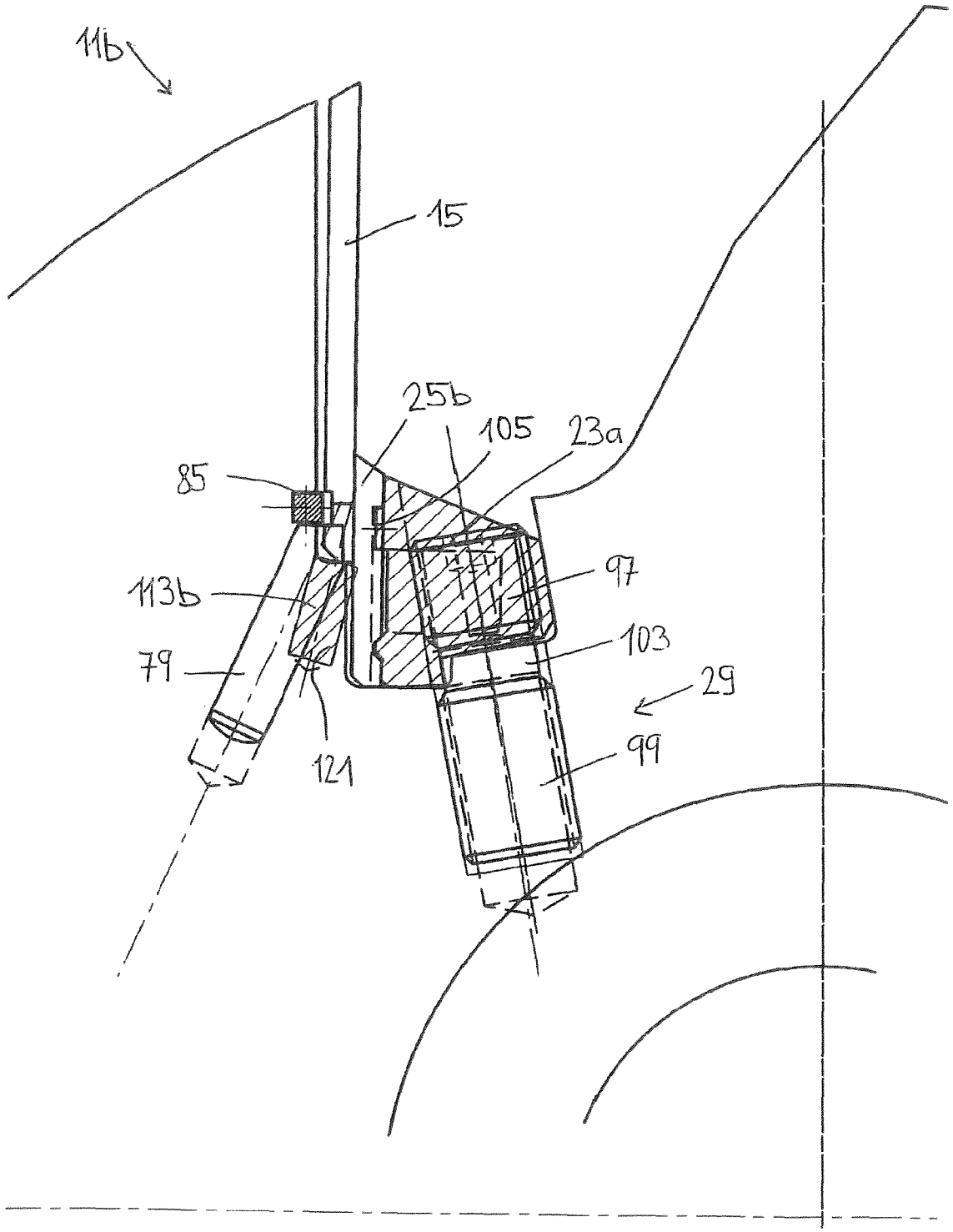
Figure 14:
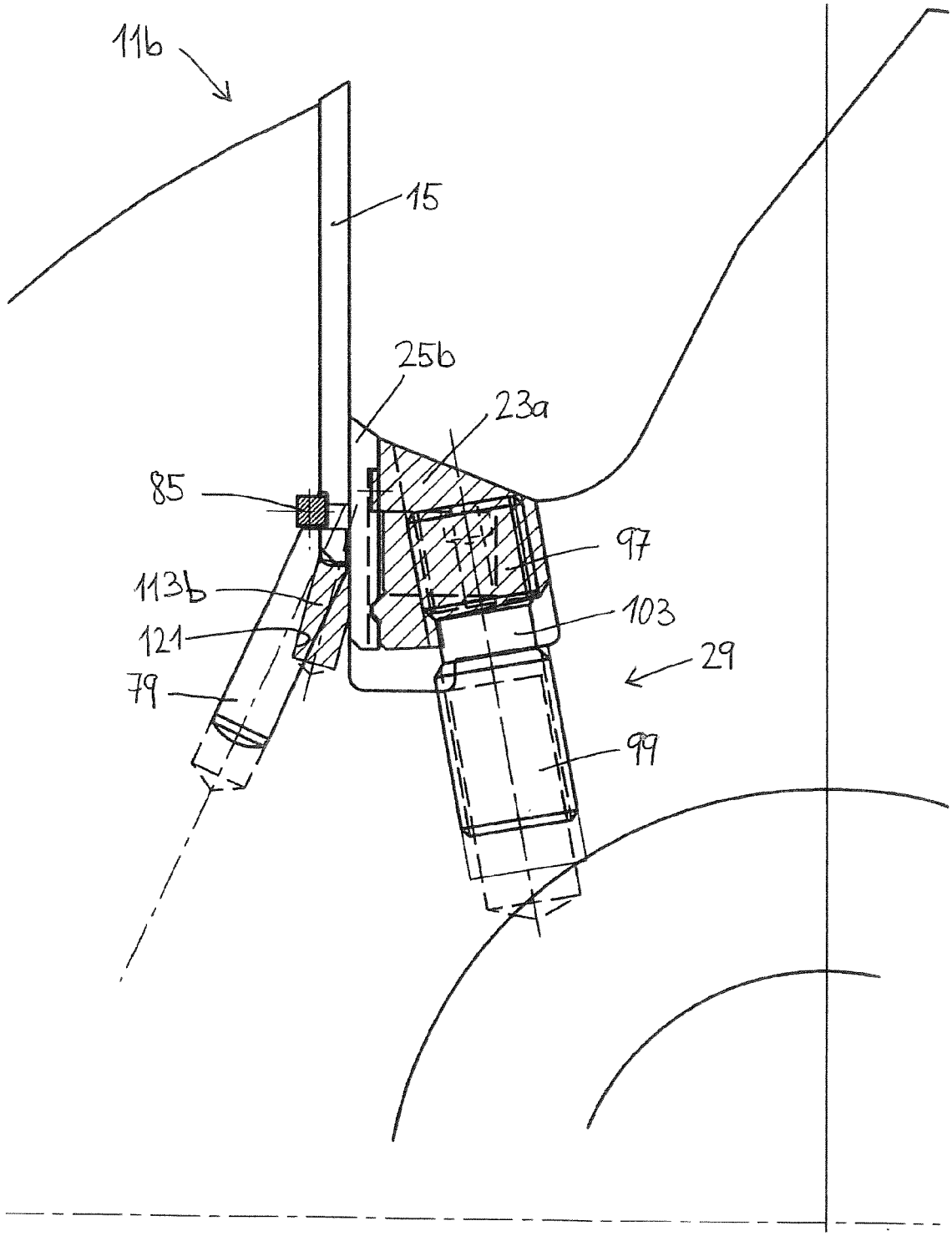
Figure 15:
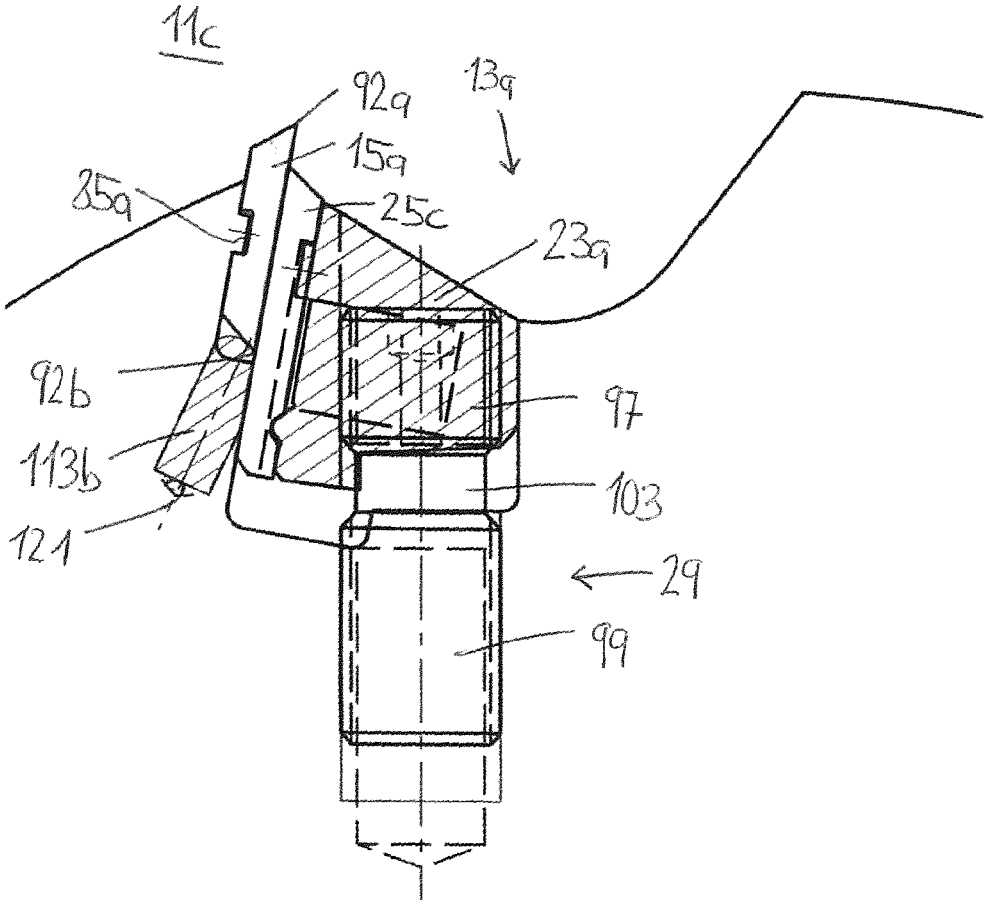
Figure 16:
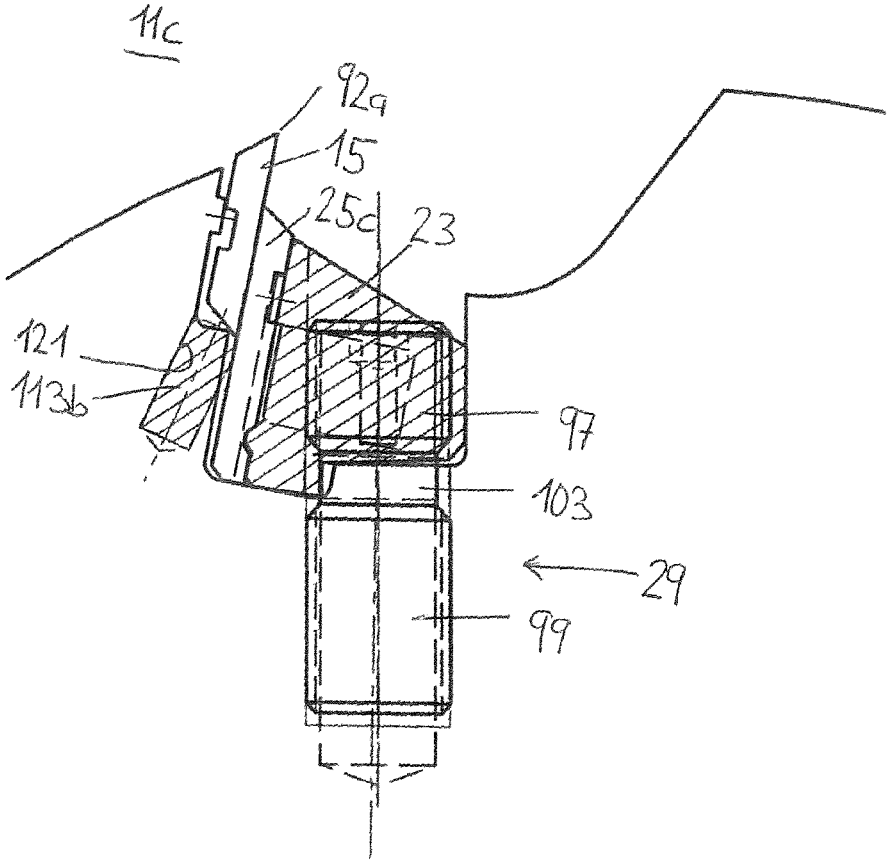
Figure 17:
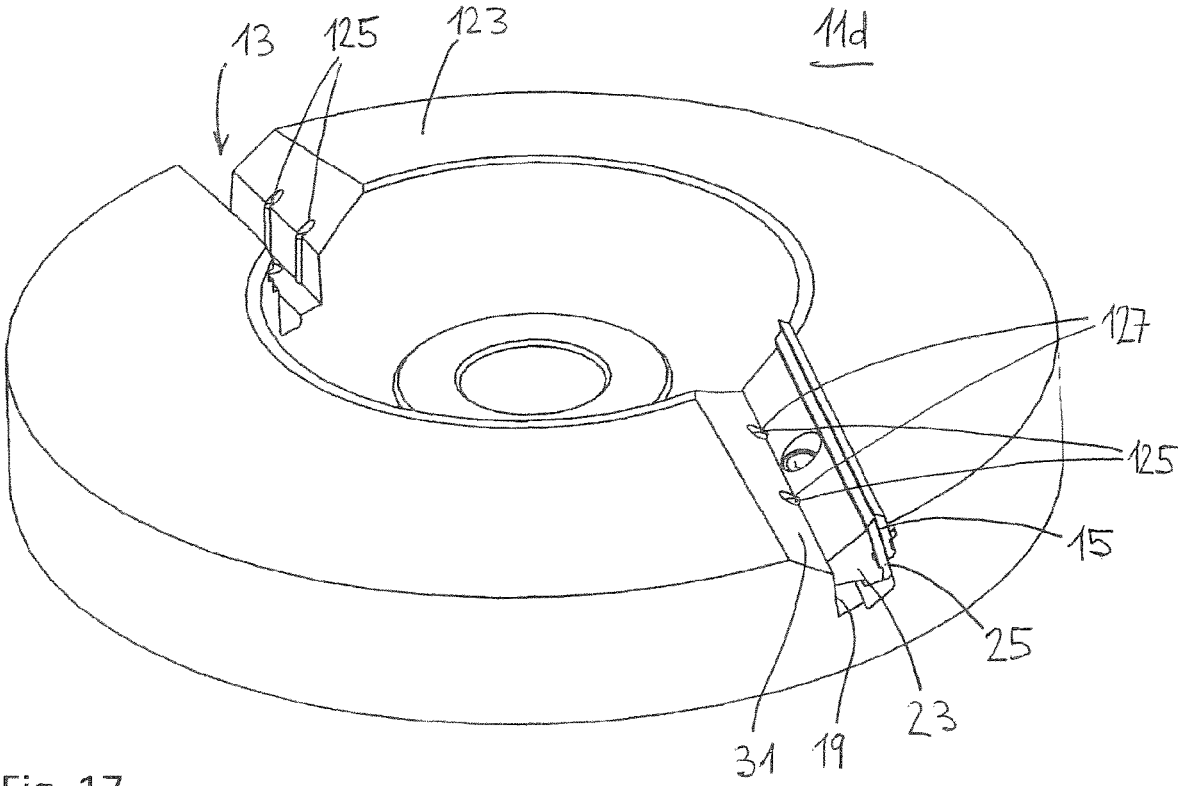
Figure 18:
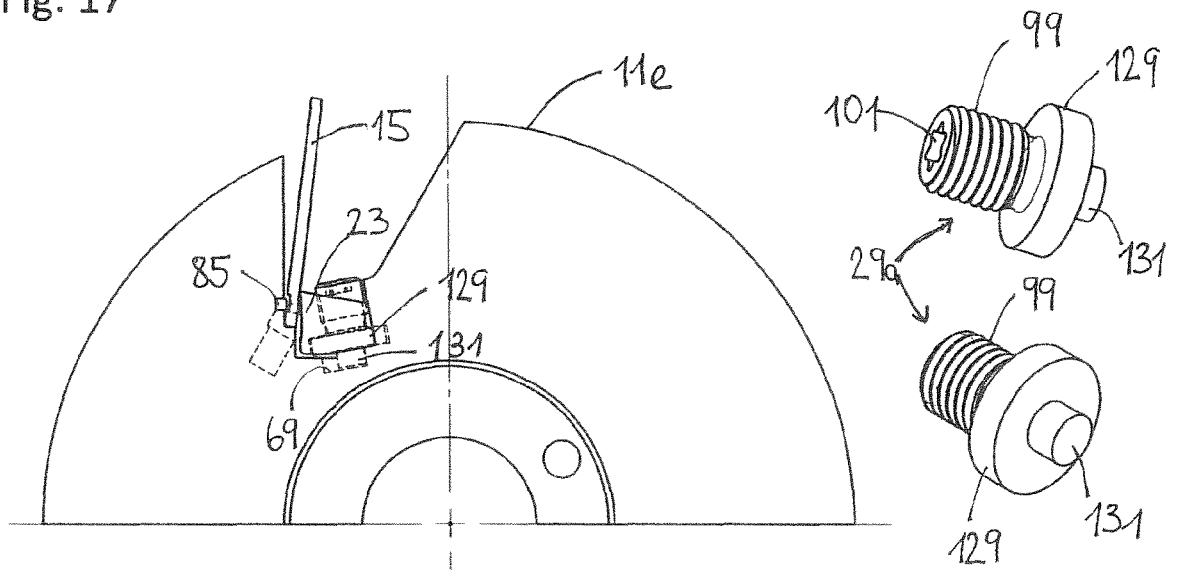
Figure 19:
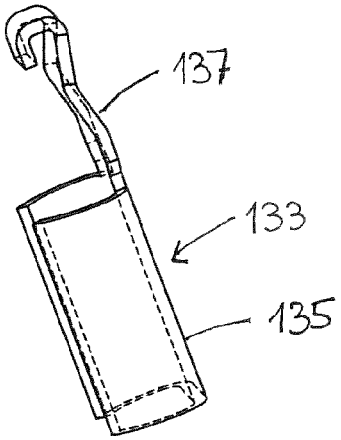
Figure 20:
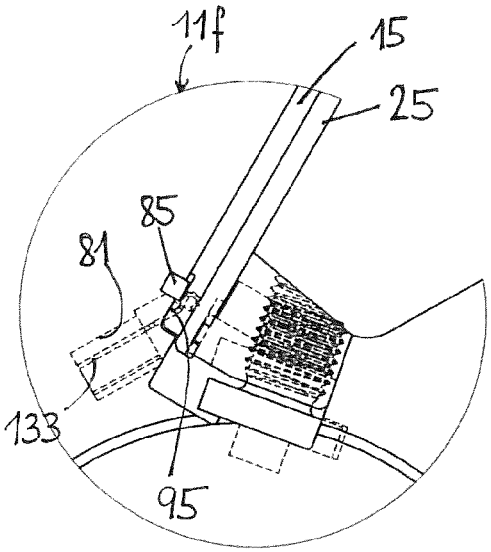
Figure 21:
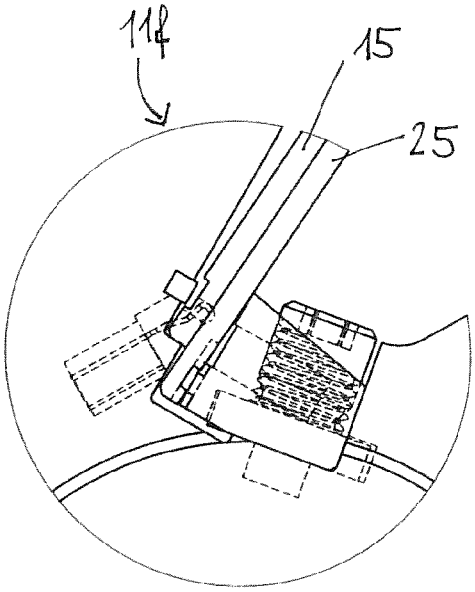

Embodiments of the invention will now be described in more detail with reference to the following figures, in which:

FIG. 1: is a partial side view of a first embodiment of an individual tool mount of a tool head with a cutting insert clamped by a closure element and a centrifugal wedge (working position);

FIG. 2: is a view as in FIG. 1, the cutting insert being in the change position;

FIG. 3: is a side view of the entire tool head, the cutting insert being in the change position;

FIG. 4: is a front view and a side view of the centrifugal wedge;

FIG. 5: is a front elevation view and a side view of the closure element;

FIG. 6: is a front elevation view and a side view of a cutting insert configured as a (moulding) knife;

FIG. 7: shows a screw with two threaded portions for clamping and releasing the centrifugal wedge;

FIG. 8: shows a further embodiment of a centrifugal wedge according to the invention;

FIG. 9: shows a further embodiment of a closure element according to the invention with a cross channel at a distance from the base of the blade and with a positioning aid;

FIG. 10: is a front elevation view and a side view of two further embodiments of a cutting insert in the form of a moulding knife, the cutting inserts differing in the elongate recesses;

FIG. 11: is a partial view of a second embodiment of an individual tool mount of a tool head with a centrifugal wedge according to FIG. 8 and with a resilient pressure element for positioning the cutting insert in the tool change position;

FIG. 12: shows the tool head of FIG. 11 with the cutting insert in the (clamped) working position;

FIG. 13: is a partial view of a third embodiment of an individual tool mount of a tool head with a modified pressure element and a short closure element; and FIG. 14: shows the tool head of FIG. 13 with the cutting insert in the (clamped) working position;

FIG. 15: is a partial view of a fourth embodiment of an individual tool mount of a scraper tool head with a short cutting insert;

FIG. 16: shows the tool head of FIG. 15 with the cutting insert in the tool change position;

FIG. 17: shows a further embodiment of a tool head in the form of a flattening cutter head;

FIG. 18: shows an additional embodiment of a tool head, in which the clamping screw is a clamping pin which is supported by its head on the base of the groove;

FIG. 19: shows an embodiment of a spring element which ensures the radial positioning of the cutting insert when the tool is clamped;

FIG. 20: is an enlarged detail view of the spring element of FIG. 19 when it has been inserted into the tool mount and the cutting insert is clamped by the centrifugal wedge;

FIG. 21: is also an enlarged view of the spring element of FIG. 19 when the cutting insert has been introduced into the tool mount and the centrifugal wedge is released.

FIGS. 1 to 7 show a tool head 11 according to the invention for the rotating machining of wood and the components thereof. It has a plurality of tool mounts 13 which are distributed over the circumference and in which a respective tool in the form of a cutting insert 15 can be received. Provided in the tool mount 13 is a groove 19 which tapers in the radial direction and which can run axially parallel or at an angle to the rotational axis 17 of the tool head 11. A centrifugal wedge 23 and a closure element 25 are used to clamp the cutting insert 15 which, in the illustrated example, is formed by a moulding knife 21 (FIG. 6). The closure element 25 rests against the cutting insert 15 and is pressed against the flat side of the cutting insert 15 by the centrifugal wedge 23. Thus, the cutting insert is clamped between a first groove wall 27 of the tool head 11 and the closure element 25 in the working or clamping position. The tool head according to the invention is distinguished in that the cutting insert can be inserted into and removed from the tool mount 13 in the radial direction. Furthermore, the closure element 25 is held in the tool mount 13 without screws. A further distinctive feature is that the centrifugal wedge 23 is clamped and released by a single screw 29 for all widths within the application field according to the invention (typically between 7 mm and 150 mm, or between 15 and 100 mm), i.e. a hammer is no longer required to release the tool holder, as is usually the case for conventional tool heads. The aforementioned distinctive features of the tool head according to the invention will be explained in more detail in the following description.

As mentioned above, the groove 19 tapers outwards in a wedge shape in the radial direction, i.e. the first groove wall 27 and a second groove wall 31 opposite the first groove wall 27 are inclined with respect to one another. The centrifugal wedge 23 is received in the groove 19. The configuration of the centrifugal wedge 23 and of the groove 19 is such that the centrifugal wedge can be inserted into the groove 19 in the radial direction when the closure element 25 is not present. However, it is also conceivable that the configuration of the centrifugal wedge 23 and of the groove 19 is such that only a lateral insertion is possible. Both embodiments are equally possible within the scope of the present invention.

The centrifugal wedge 23 has a front wedge surface 33 which rests against the closure element 25, and a rear surface 35 which rests in a planar manner on the second groove wall 31. If the closure element is not provided, the front wedge surface 33 rests directly on the cutting insert. The front wedge surface 33 is interrupted by a recess 37 which extends in the longitudinal direction of the centrifugal wedge 23, so that a first contact surface 39 is present above the recess 37 and a second contact surface 41 is present below the recess. The second contact surface 41 has an elevation 43 in the form of a bead which extends in the longitudinal direction and allows a positive locking connection with a corresponding, complementarily formed recess 47 in the closure element 25.

The base of the centrifugal wedge 23 is step-shaped so that a first base surface 49 is present adjoining the front wedge surface 33 and a second base surface 51 is present adjoining the rear surface 35. The first and second base surfaces 49, 51 are separated by a step 53 which extends substantially parallel to the rear surface 35. In this respect, the second base surface 51 includes an angle of 90 degrees or more, or between 91 and 93 degrees, with the rear surface 35. This can cause the centrifugal wedge 23 to tilt in the change position, as will be explained in more detail further below.

In order to reduce weight, one or more spaced-apart slots 55 can be provided in the centrifugal wedge 23. Located between the slots 55 is a screw hole 57 with a longitudinal axis 59, which screw hole extends from the top surface 61 to the second base surface 51. The longitudinal axis 59 of the screw hole 57 extends substantially parallel to the rear surface 35. The screw hole 57 has an internal thread 63 to receive a rear threaded portion 99 of the screw 29 (FIG. 7).

The base of the groove is also step-shaped analogously to the base surface 49, 51 of the centrifugal wedge 23. It comprises a first groove base surface 65 which corresponds to the second base surface 51 of the centrifugal wedge 23, and a second groove base surface 67 which corresponds to the first base surface 49. A screw hole 60 with an internal thread 70 is provided in the first groove base surface 65. The screw hole 69 is collinear with the longitudinal axis 59, so that by turning the screw 29, the centrifugal wedge 23 can be moved from an upper clamping position in which the closure element 25 and the cutting insert 15 are pressed firmly against the first groove wall 27, into a lower tool change position in which the cutting insert 15 can be removed in the radial direction.

As mentioned above, while the base surface 51 includes an angle of 90 degrees with the rear surface 35, the angle between the first groove base surface 65 and the rear surface 31 is approximately 90 degrees. If the base surface 51 includes an angle of >90 degrees with the rear surface 35, when the tool mount is opened, the second base surface 51 of the centrifugal wedge 23 near the step 53 thus firstly comes into contact with the first groove base surface 65. Consequently, on reaching the tool change position, a transverse force acts on the centrifugal wedge 23, which transverse force causes the centrifugal wedge 23 to tilt due to the existing tolerances of the screw thread (FIG. 2). In so doing, the closure element 25 and the cutting insert 15 are released from the first side wall 27.

A distinctive feature of the closure element 25 is that at least one, but or two or more magnets 69 are provided in the lower region (FIG. 5). These are received in openings 71 flush with the adjoining surface of the tool. The magnets 69 serve to hold the cutting inserts 15, consisting of a generally weakly magnetisable material, such that they adhere to the closure element 25, particularly during a tool change, so that the tool can be removed relatively easily.

Two elastically deformable plastics nubs 73, in particular those of an elastomeric material, are provided in the closure element 25 at a distance from one another just above the recess 47. These nubs can be introduced into corresponding holes 75 in the closure element 25. The purpose of the nubs 73 is to push the cutting insert 15 upwards during the clamping procedure. The mode of operation of the nubs 73 is described in more detail further below.

A U-shaped recess 77 in the centre of the rear fixing portion is provided for the lateral centring of the closure element 25 in the groove 19. Engaging in this recess 77 in the clamping position is an axially adjustable centring pin 79 which is received in a pinhole 81 in the body of the tool head (FIGS. 1 to 3). The pinhole 81 is worked into the tool head body at an angle to the first groove wall 27.

A single channel 83 is provided in the first groove wall 27 just above the pinhole 81. A stop ledge 85 is received positively in this channel 83. The channel 83 and the corresponding stop ledge 85 can be four-sided or polygonal or round in cross section. In the clamping position, the stop ledge 85 cooperates with a groove 87 in the cutting insert 15 for accurate positioning (FIG. 6). This groove 87 is wider than the stop ledge 85 by a particular distance, by at least 5% or by at least 10%. The groove 87 is advantageously between 20 and 80% wider than the stop ledge. In specific embodiments, the groove 87 is between 30% and 60% wider than the stop ledge 85. It is conceivable that instead of the stop ledge 85, a corresponding elongate stop 85*a* is formed directly in the groove wall 27.

The cutting insert 15 which, according to FIG. 6, is configured as a moulding knife 21, can have in the centre in the base of the tool and analogously to the closure element 25, a U-shaped recess 89 which is used to centre the cutting insert 15. When the cutting insert 15 is introduced into the groove 19, the head of the centring pin 79 engages in the U-shaped recesses 77, 89 in the closure element 25 and in the cutting insert 15 so that they come to rest exactly one above the other. Formed on the front 90 of the cutting insert is a cutting edge 92. A functional surface in the form of a bevel 94 is formed on the edge diagonally opposite the cutting edge 92.

As can be seen in FIGS. 1 to 3, the first groove wall 27 is not a straight surface, but it has at a distance from the base of the groove a shoulder 91 against which the cutting insert can rest. Here, the rear (set-back) wall portion above the shoulder 91 is identified by reference numeral 93 and the front (upstream) wall portion is identified by reference numeral 95. The shoulder 91 has a depth which substantially corresponds to the thickness of a cutting insert 15 to be clamped. Thus, when a cutting insert 15 has been introduced, the front thereof is substantially flush with the front wall portion 95.

Within the context of the present invention, those portions of the tool mount which cooperate in the tool mounting are referred to as groove 19. According thereto, the groove 19 has first and second groove walls 27 and 31 which differ in length.

The rear wall portion 93 of the first groove wall 27 above the shoulder 91 can be slightly inclined inwards relative to the front wall portion 95 and can include an angle of up to 5 degrees (see FIG. 3). Consequently, the tool can be pretensioned to an even greater extent against the groove wall 27 in the front region.

The screw 29 for clamping and releasing the centrifugal wedge 23 is configured as a threaded pin having a front and a rear threaded portion 97 and 99 respectively (FIG. 7). At the back, the screw has an engagement means 101 for a tool, for example a square socket or a hexagon or a Torx® thread. The front and rear threaded portions 97, 99 are separated from each other by a narrowing 103. The front threaded portion 97 is configured to cooperate with the internal thread 70 of the screw hole 69. The rear threaded portion 99 is configured to cooperate with the internal thread 63, formed in the centrifugal wedge 23, of the screw hole 57. A distinctive feature of the described screw connection is that the front and rear threaded portions 97, 99 have opposite screw threads. According to one embodiment, the front threaded portion 97 is a left-hand thread and the rear threaded portion 99 is a right-hand thread. This has the advantage that in order to clamp the centrifugal wedge, the screw can be turned in the usual direction. In so doing, the radial position of the centrifugal wedge 23 changes during a full screw rotation just by two thread turns.

A further modified embodiment of a centrifugal wedge 23 has on the wedge surface 33 a centring element 105 in the form of a centring nub which projects out of the wedge surface 33 (FIG. 8). The centring element 105 is used to laterally centre the closure element 25*a*, shown in FIG. 9, by positive locking. Unlike the closure element 25 according to FIG. 5, the closure element 25*a* merely has a U-shaped recess 107, instead of a recess 77 in the surface oriented towards the centrifugal wedge 23. This recess 107 extends in the centre of the closure element 25*a* at a right angle from the base 109 of the closure element 25*a* (centre axis 102).

Further differences are that the closure element 25*a* does not have any magnets or plastics nubs.

FIGS. 11 and 12 show a tool head 11*a* with the centrifugal wedge 23 and the closure element 25*a* according to FIG. 9. Unlike the first embodiment according to FIGS. 1 to 7, the tool head 11*a* has a sleeve-shaped pressure element 113*a* which is inserted into a widened, front pinhole portion 115 of the pinhole 81. The upper edge of the pressure element 113*a* projects out of the front wall portion 95 on the groove-side at the shoulder 91. As shown in FIG. 11, in the change position of the tool mount, the pressure element 113*a* presses against the closure element 25*a* and pretensions it against the centrifugal wedge 23. During clamping of the cutting insert 15, the part, projecting out of the wall portion 95, of the elastically deformable pressure element 113*a* is deformed and presses the cutting insert 15 radially outwards and thus against the stop ledge 85. Consequently, the cutting insert 15 is centred automatically in the radial direction. As can be seen in FIG. 12, there is a clearance between the stop ledge 85 and the recess 87, i.e. the recess 87 is wider than the stop ledge 85 by a particular amount, between 0.05 and 1.5 mm or between 0.3 and 1.0 mm. When the cutting insert 15 is loosely introduced into the tool mount and rests on the shoulder 91 (FIG. 9), the upper edge 117 of the stop ledge 85 can substantially correspond to the inner side edge 119 of the recess 87.

The embodiment according to FIGS. 13 and 14 differs from that of FIGS. 11 and 12 in that at least one pressure element 113*b*, or two pressure elements 113*b* is/are received in a separate blind hole 121 which is provided in the region of the shoulder 91 in the body of the tool head. A respective blind hole 121 and a pressure element 113*b* are provided symmetrically on both sides of the centring pin 79. The mode of operation of the pressure element 113*b* is the same as that of pressure element 113*a*, i.e. the part of the pressure element 113*b* protruding out of the blind hole 121 and out of the wall portion 95 causes a radial centring of the cutting insert 15 during clamping. A further modification of this embodiment is found in the region of the lateral positioning of the cutting insert 15. The cutting insert 15 does not have a U-shaped recess for the lateral positioning. For lateral positioning, the positioning pin 79 is moved axially outside the cutting insert 15, so that the cutting insert 15 can be struck either on the left-hand side or on the right-hand side of the positioning pin 79.

FIGS. 15 and 16 show a further tool head 11*c*, in which the tool mount 13*a* forms a less deep indentation than in the case of the tool heads described above and the cutting insert 15*a* only has a small height and has two cutting edges 92*a*, 92*b*. Accordingly, the closure element 25*c* is also shorter than in the other embodiments. Unlike the tool heads described above, the tool head 11*c* has a stop ledge 85*a* which is integral with the tool body. Furthermore, a centring pin is not arranged centrally, but a lateral stop is provided for the lateral centring of the cutting insert (not shown in the figures). Otherwise, the tool head 11*c* conforms with the other tool heads in respect of function and construction, so that a more detailed description is unnecessary.

The tool head 11*d* according to FIG. 17 is a flattening cutter head which differs from the embodiments described hitherto in that the tool mount 13 is not provided in the circumference, but in the end face 123 of the tool head 11*d*. Due to this construction, the centrifugal forces which are generated as the tool head rotates still only slightly act on the closure element 25 and on the cutting insert 15. To nevertheless accurately hold the centrifugal wedge 23 in the groove 19, there are provided in the groove wall 31 two spaced-apart reinforcing elements 125 which project out of the wall and cooperate positively with corresponding channels 127 in the centrifugal wedge 23.

A modified clamping mechanism is shown in the case of the tool head 11*e* according to FIG. 18. This clamping mechanism differs from those described above in that the clamping screw 29*a* only has a rear thread 99. Provided on the front of the clamping screw 29*a* is a head 129 which is supported on the base 65, 67 of the groove. Furthermore, formed on the head 129 is a centring extension 131 which engages in the screw hole 60 which, in this case, does not have to have an internal thread. In principle, the centring extension can also be omitted, as it is not required for clamping the cutting insert. Furthermore, in the described embodiment of a tool head, a closure element is not provided, but the centrifugal wedge 23 acts directly on the cutting insert 15.

FIGS. 19 to 21 show an embodiment of a spring element 133 which, on the one hand, assumes the function of the centring pin described above (see FIG. 3) for the lateral orientation of the cutting insert and on the other hand assumes the function of the pressure element for the radial positioning of the cutting insert. The spring element 133 has a rear clamping portion 135, comparable to a heavy type dowel pin, which can be inserted into the pinhole 81. Formed on the clamping portion 135 is a flexible tongue 137 with an end nose 139 which, when inserted into the pinhole 81, projects over the front wall portion 95. As shown in FIGS. 20 and 21, the flexible tongue 137 presses by the nose 139 on the closure element 25, presses it away and thus facilitates the removal of the cutting insert 15 when the centrifugal wedge is released (FIG. 21).

The tool head according to the invention is used as follows: to introduce a new cutting insert into the tool head according to FIGS. 1 to 3, the centrifugal wedge 23 is firstly brought against the base of the groove by turning the clamping screw as far as possible in the appropriate direction of rotation. In the tool change position which is then assumed, the centrifugal wedge 23 is tilted relative to the first groove wall 27, so that a radially opening gap is formed between the closure element 25 and the rear wall portion 93 of the groove wall 27 (FIG. 2). The new cutting insert can then be introduced into the gap, the centring pin 79 ensuring the correct lateral centring of the cutting insert 15. In the then assumed position, the cutting insert 15 rests against the shoulder 91. The elastically deformable pressure elements 73, 113*a*, 113*b* can also contact the base of the cutting insert or can be arranged at a short distance therefrom. If the screw 29 is then turned in the clamping direction, the pressure elements 73, 113*a*, 113*b* are clamped between the front wall portion 95 and the closure element. These expand laterally and push the cutting insert radially outwards, so that the cutting insert rests on the stop ledge 85 with the lower edge 100 of the groove 87. In this respect, the position of the groove 87 and especially the position of the lower edge 100 based on the base 108 of the cutting insert play an important part. Only in this way is it ensured that the expansion of the pressure elements is sufficient during the clamping of the tool to ensure an exact positioning of the cutting insert in the radial direction during the clamping procedure. This measure ensures an exact positioning of the cutting insert in the radial direction, which significantly increases the accuracy of the work which is to be carried out. The screw 29 is turned until the centrifugal wedge rests firmly against the closure element 25. The clamping force is intensified by the centrifugal force which is generated during the use of the rotating tool head.

The tool head according to the invention is used in particular for machining wood, plastics and similar materials, for which the method when machining and removing chips or particles is similar. Similar materials are, for example cork, bone, plastics, light metal alloys, wood materials such as chipboard, fibreboard, plywood etc. Cutting inserts having a straight, curved or profiled cutting edge are used as the tools. The cutting inserts consist of flat blades which are between approximately 1 mm and 3 mm thick. During operation, the cutter head is arranged in a rotatably fixed manner on a spindle of a woodworking machine, it being possible for further cutter heads to be attached to the spindle in a directly adjacent position. According to one aspect of the invention, the centrifugal wedge can be adjusted (clamped and released) by a single screw for all scopes of application. In this respect, the cutting insert is pressed onto the stop ledge 85 in the flight direction during clamping, so that the cutting insert cannot move any further as the tool head rotates.

In the above description, the embodiments are respectively described by way of example on the basis of a tool head which is circular cylindrical in cross section and in which the tool is received in an axial groove (axially parallel to the rotational axis). However, within the scope of the invention, the tool mount or respectively groove can also extend at an angle to the rotational axis (for example, conical tool head). Thus, the groove can be at 3 spatial angles relative to the rotational axis and can thereby define a rake angle, an offset angle and an axis angle.

What is claimed is:

1. A tool head for a woodworking machine having a cylindrical, conical or profiled main part, comprising:

at least two tool mounts, each of the at least two tool mounts comprising:

a groove that tapers in a radial direction so as to be wider at a base of the groove, the groove having a first side wall and a second side wall;

a cutting insert abutting the first side wall of the groove, the cutting insert having a first side configured to engage and connect to the first side wall of the groove and having a planar second side, the first side of the cutting insert and the first side wall of the groove positively locked together to retain the cutting insert relative to the first side wall;

a closure element having a planar first side abutting against the planar second side of the cutting insert; and a centrifugal wedge positioned between the closure element and the second side wall opposite the first side wall, the centrifugal wedge having a first side configured to engage and connect to a second side of the closure element, the first side of the centrifugal wedge and the second side of the closure element positively locked together with the centrifugal wedge abutting against the second side of the closure element to retain the closure element relative to the centrifugal wedge;

wherein the centrifugal wedge applies a clamping force against the closure element and the cutting insert to hold the cutting insert to the first side wall, wherein the centrifugal wedge increases the clamping force against the closure element and the cutting insert resulting from a centrifugal force applied to the centrifugal wedge when the tool head is rotated during use and wherein the centrifugal wedge is moveable radially inward and into a tool change position by turning a clamping screw in a first direction until the cutting insert is disengaged from the first side wall and be radially removed from the groove.

2. The tool head according to claim 1, wherein the centrifugal wedge has a hole with an internal thread into which the clamping screw is introduced, wherein the centrifugal wedge is movable radially outward into a clamping position by turning the clamping screw in a second opposite direction to lock the cutting insert to the first side wall and the closure element to the centrifugal wedge and can be moved into the tool change position by turning the clamping screw in the first direction.

3. The tool head according to claim 1, wherein the base of the groove defines a screw hole with an internal thread and the shank of the clamping screw has two threaded portions with opposite screw threads, one threaded portion cooperating with the internal thread of the screw hole and the other threaded portion cooperating with the internal thread of the hole.

4. The tool head according to claim 1, wherein the closure element or the centrifugal wedge is provided with at least one magnet.

5. The tool head according to claim 1, further comprising a spring element positioned to act in the radial direction on the cutting insert to press the cutting insert against a stop before reaching a final clamping position.

6. A method for inserting and clamping a cutting insert in a mount of a tool head, comprising:

introducing a cutting insert into a gap between a first side wall of a groove and a closure element, the groove tapering in a radial direction so as to be wider at a base of the groove;

producing a first positive locking connection between the cutting insert and the first side wall of the groove;

clamping the cutting insert with a centrifugal wedge; and producing a second positive locking connection between the closure element and the centrifugal wedge when the closure element is inserted into the tool mount, wherein the cutting insert is locked to the first positive locking connection to the first side wall and the closure element is locked to the centrifugal wedge by the second positive locking connection, with the closure element forcing the cutting insert into engagement with the first positive locking connection between the cutting insert and the first side wall;

wherein a first side of the cutting insert abuts the first side wall of the groove such that a first locking connection of the side wall engages with a second locking connection of the first side of the cutting insert and wherein a second side of the cutting insert is planar;

wherein the closure element has a planar first side abutting against the planar second side of the cutting insert and has a third locking connection on a second side thereof; and wherein the centrifugal wedge is positioned between the closure element and the second side wall opposite the first side wall of the groove, the centrifugal wedge having a fourth locking connection on a first side thereof, the fourth locking connection engaging with the third locking connection of the closure element, the centrifugal wedge abutting against the second side of the closure element;

wherein the centrifugal wedge has a hole with an internal thread into which a clamping screw is introduced, wherein the centrifugal wedge is moveable radially outward into a clamping position by turning the clamping screw in a first direction to lock the cutting insert to the first side wall and the closure element to the centrifugal wedge, with the centrifugal wedge applying a clamping force to the closure element and the cutting insert to hold the second locking connection of the cutting insert to the first locking connection of the first side wall, wherein the centrifugal wedge increases the clamping force against the closure element and the cutting insert resulting from a centrifugal force applied to the centrifugal wedge when the tool head is rotated during use and wherein the centrifugal wedge is moveable radially inward and into a tool change position by turning the clamping screw in a second, opposite direction until the cutting insert is disengaged from the first side wall and be radially removed from the groove.

7. The method according to claim 6, further comprising pressing the cutting insert against a stop before reaching a final clamping position.

8. The method according to claim 6, further comprising automatically positioning the cutting insert radially with a resilient pressure element when clamping.

9. A tool system having a tool head for a woodworking machine having a cylindrical, conical or profiled main part with a tool mount defining a groove that tapers in a radial direction so as to be wider at a base of the groove, the groove having a first side wall and a second side wall opposite the first side wall, a closure element having a planar first side abutting against a planar second side of a cutting insert, a second side of the cutting insert configured to engage and connect to the first side wall of the groove, and a centrifugal wedge positioned between the closure element and the second side wall of the groove, a first side of the centrifugal wedge engaged with and connect to the second side of the closure element, the centrifugal wedge abutting against the second side of the closure element and applying a clamping force against the closure element and the cutting insert to maintain the engagement and connection of the cutting insert to the first side wall, wherein the centrifugal wedge increases the clamping force against the closure element and the cutting insert resulting from a centrifugal force applied to the centrifugal wedge when the tool head is rotated during use and wherein the centrifugal wedge is moveable radially inward and into a tool change position by turning a clamping screw in a first direction until the cutting insert is disengaged from the first side wall and be radially removed from the groove, comprising:

a cutting insert abutting the first side wall of the groove, the cutting insert having a first side and a planar second side, the first side of the cutting insert engaged with and connected to the first side wall of the groove, the cutting insert comprising a cutting edge along a top edge of the first side thereof, the first side thereof being flat and having a longitudinally extending recess along the second side thereof, the longitudinally extending recess configured to engage with and be held relative to the tool head and having a bottom edge diagonally opposite the cutting edge defining a surface in the form of one of a bevel or a rounding, wherein the cutting insert is configured to be locked to the first side wall of the groove with a surface of a closure element abutting the first side of the cutting insert to force the cutting insert into locking engagement with the first side wall.

10. The tool system according to claim 9, wherein the bevel is greater than 0.6 mm, as seen in the cutting insert thickness.

11. The tool system according to claim 9, wherein the longitudinally extending recess is between 30% and 60% wider than a stop ledge provided in the tool mount.

12. The tool system according to claim 9, wherein the longitudinally extending recess can be angular, semicircular or V-shaped.

13. The tool system according to claim 9, wherein only a single longitudinally extending recess is provided, the lower edge of which is located in a distance of less than 10 mm from the base surface of the cutting inserts.

14. The tool system according to claim 9, wherein the cutting insert comprises a U-shaped recess for lateral positioning.

15. The tool system according to claim 9, wherein the cutting insert does further comprising a positioning pin arranged such that the cutting insert can be struck either on the left-hand side or on the right-hand side of the positioning pin.

16. The tool system according to claim 9, wherein the cutting insert comprises a flat blade with a thickness between about 1 mm and 3 mm.

17. A cutting insert for a tool head of a woodworking machine, comprising:

an elongate plate having a cutting edge along a top edge of a first side of the elongated plate and a bottom edge opposite the cutting edge defining a surface in the form of one of a bevel or a rounding, the depth of which is at least 15% of a thickness of the elongate plate, the first side of the elongate plate being planar and a second side of the elongate plate defining a longitudinally extending recess along a second side of the elongate plate, the longitudinally extending recess configured to engage with and be held relative to the tool head, the tool head comprising:

at least two tool mounts, each of the at least two tool mounts comprising:

a groove that tapers in a radial direction so as to be wider at a base of the groove, the groove having a first side wall and a second side wall, the first side wall having a first locking connection;

a closure element having a planar first side abutting against the planar side of the elongate plate a second side; and a centrifugal wedge positioned between the closure element and the second side wall opposite the first side wall, the centrifugal wedge having a first side engaged with and connected to the second side of the closure element, the centrifugal wedge abutting against and positively locking to the second side of the closure element, the centrifugal wedge applying a clamping force against the closure element and the elongate plate to hold the elongate plate to the first side wall, wherein the centrifugal wedge increases the clamping force against the closure element and the elongate plate resulting from a centrifugal force applied to the centrifugal wedge when the tool head is rotated during use and wherein the centrifugal wedge is moveable radially inward and into a tool change position by turning a clamping screw in a first direction until the elongate plate is disengaged from the first side wall and be radially removed from the groove, wherein the centrifugal wedge has a hole with an internal thread into which the clamping screw is introduced, wherein the centrifugal wedge is movable radially outward into a clamping position by turning the clamping screw in a second opposite direction to lock the elongate plate to the first side wall and the closure element to the centrifugal wedge and can be moved into a tool change position by turning the clamping screw in the first direction, the elongate plate abutting the first side wall of the groove, the elongate plate engaging with and connected to the first side wall, wherein the elongate plate is configured to be positively locked to the first side wall of the groove with a flat surface of the closure element abutting the second side of the elongate plate to force the elongate plate into engagement with the first side wall.

18. The cutting insert according to claim 17, wherein the longitudinally extending recess can be angular, semi-circular or V-shaped.

19. The cutting insert according to claim 17, wherein the bevel comprises at least 0.6 mm of the cutting insert thickness.

20. The cutting insert of claim 17, wherein only a single longitudinally extending recess is provided, the lower edge of which is at a distance of less than 10 mm from the base surface of the cutting insert.

21. The cutting insert of claim 17, wherein for lateral positioning, the cutting insert defines a U-shaped recess.

22. The cutting insert of claim 17, wherein for lateral positioning the cutting insert can be struck either on a left-hand side or on a right-hand side of a positioning pin if the cutting insert does not include a U-shaped recess.

* * * * *